US006460823B1

(12) United States Patent
Herder et al.

(10) Patent No.: US 6,460,823 B1
(45) Date of Patent: Oct. 8, 2002

(54) MOVABLE MOUNTING LUG FOR A COMPRESSOR

(75) Inventors: David Henry Herder, Plymouth, MI (US); Peggy Ann Fyie, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/474,618

(22) Filed: Dec. 29, 1999

(51) Int. Cl.[7] ..... F16M 1/00; F04B 17/00

(52) U.S. Cl. ..... 248/637; 248/672; 417/360

(58) Field of Search ..... 248/637, 610, 248/674, 672; 403/302, 306; 417/360, 362, 364, 231, 572; 418/270

(56) References Cited

U.S. PATENT DOCUMENTS

| | | | | | |
|---|---|---|---|---|---|
| 3,476,309 | A | * | 11/1969 | Harlin | 417/572 |
| 3,850,551 | A | * | 11/1974 | Gamache et al. | 417/410.3 |
| 4,560,332 | A | * | 12/1985 | Yokoyama et al. | 418/83 |
| 4,600,367 | A | * | 7/1986 | Terauchi et al. | 417/360 |
| 4,938,448 | A | * | 7/1990 | Shimazaki | 248/635 |
| 4,993,682 | A | * | 2/1991 | Imai et al. | 248/638 |
| 5,269,662 | A | * | 12/1993 | Denton et al. | 417/319 |
| 5,454,543 | A | * | 10/1995 | Carrico | 248/674 |
| 5,470,207 | A | * | 11/1995 | Shockey et al. | 417/313 |
| 5,737,913 | A | * | 4/1998 | Terry | 285/360 |
| 6,324,744 | B1 | * | 12/2001 | Banks et al. | 123/195 A |
| 6,422,527 | B1 | * | 7/2002 | Lees | 248/672 |

FOREIGN PATENT DOCUMENTS

| | | | |
|---|---|---|---|
| EP | 0 339 682 A2 | | 11/1989 |
| JP | 54-162217 | | 12/1979 |
| JP | 3-273926 | | 12/1991 |
| JP | 08093990 A | * | 4/1996 |
| JP | 08261165 A | * | 10/1996 |

* cited by examiner

*Primary Examiner*—Anita King
*Assistant Examiner*—Naschica S. Morrison
(74) *Attorney, Agent, or Firm*—Scott Confer, Esq.

(57) ABSTRACT

A mounting lug 10 for use on a variable capacity swash plate type compressor that is movably disposed on the outer surface of the compressor housing 26. The mounting lug 10 facilitates the mounting of a single swash plate type compressor in a variety of vehicles, thereby eliminating the requirement of producing a different mold to cast a compressor housing 26 for each different vehicle in which the swash plate type compressor will be installed.

5 Claims, 5 Drawing Sheets

MOVABLE MOUNTING LUG FOR A COMPRESSOR

FIELD OF THE INVENTION

The present invention relates to a mounting lug, and more particularly to a movable mounting lug for a variable capacity swash plate type compressor adapted for use in an air conditioning system for a vehicle.

BACKGROUND OF THE INVENTION

Variable capacity swash plate type compressors are typically used in air conditioning systems for vehicles. The compressors are typically mounted within a vehicle engine compartment to an engine or mounting bracket by appropriate mounting lugs. The location of the mounting lugs on the compressor must be orientable with the mounting brackets on the vehicle and therefore dictated by the make and model of the vehicle.

In the prior art, fixed mounting lug locations have been used. When different mounting lug locations were required to facilitate the support of an associated compressor, unique castings were required. An individual die casting tool is typically quite expensive, depending on the complexity of the compressor. Each compressor may be used in several different vehicles requiring different mounting lug locations to accommodate the mounting of the compressor, thereby requiring a unique casting for each vehicle.

An object of the invention is to produce a movable mounting lug which may be economically produced.

Another object of the invention is to produce a movable mounting lug wherein the mounting lug can be disposed in a variety of axial positions on the outer surface of a variable capacity swash plate type compressor.

Another object of the invention is to produce a movable mounting lug wherein a single variable capacity swash plate type compressor may be mounted in a variety of vehicles.

Still another object of the present invention is to produce a movable mounting lug that facilitates mounting a swash plate type compressor on vehicle models having different mounting configurations and eliminates the requirement of producing separate die casting tools for each vehicle model.

SUMMARY OF THE INVENTION

The above, as well as other objects of the invention, may be readily achieved by a mounting lug comprising a main body having a centrally disposed aperture for receiving a mounting bolt, the main body extending from an outer surface of a compressor housing, wherein the main body is variably positionable on the outer surface of the compressor housing.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENTS

Figure 1:
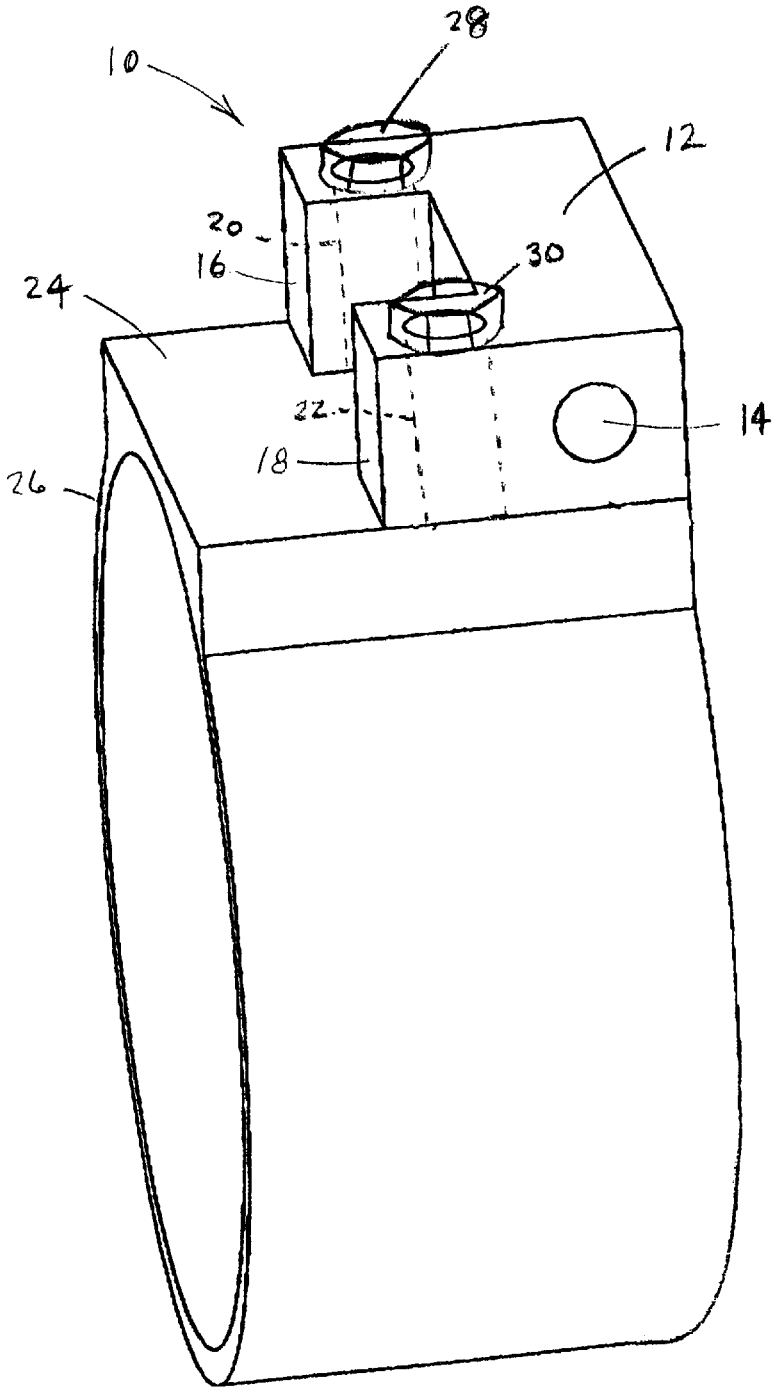
FIG. 1 is a perspective view of a movable mounting lug for a variable capacity swash plate type compressor embodying the features of the present invention.

A mounting lug according to this invention is indicated generally at 10 in FIG. 1. The mounting lug 10 includes a main body 12. The main body 12 has a centrally disposed aperture 14 extending therethrough. Two shoulder portions 16, 18 extend outwardly from the main body 12. The shoulder portions 16, 18 are spaced apart from one another and extend in a generally parallel relationship to each another. Elongated holes 20, 22 are formed in the shoulder portions 16, 18, respectively. Each of the main body 12 and shoulder portions 16, 18 has a substantially planar lower surface. The lower surfaces of the main body 12 and shoulder portions 16, 18 are aligned in the same plane. Preferably, the main body 12 and shoulder portions 16, 18 are formed as an integral member.

The mounting lug 10 is disposed on a protruding surface 24 formed on a compressor housing 26. Preferably, the protruding surface 24 is planar or flat. The compressor housing 26 is a generally cylindrical, hollow member that encloses well-known components of a compressor. The compressor housing 26 may be provided with one or more mounting lugs 10. The number of mounting lugs 10 which may be required depend upon the number and position of mounting brackets (not shown) that are provided on a vehicle in which the compressor housing 26 is to be mounted.

The mounting lugs 10 can be provided at any location on the compressor housing 26. The location of the mounting lugs 10 is selected to correspond to the location of mounting brackets on the vehicle in which the compressor housing 26 is to be mounted. For each mounting lug 10, a protruding surface 24 is provided on an outer surface of the compressor housing 26. In the embodiment of FIG. 1, a longitudinal axis of the aperture 14 is formed to extend substantially perpendicular to a longitudinal axis of the compressor housing 26 and substantially tangent to the outer surface of the compressor housing 26.

The mounting lug 10 can be fixedly attached at any position along the flat surface 24 of the compressor housing 26. The precise position of the mounting lug 10 corresponds to the mounting requirements for a vehicle, such as the position of a mounting bracket (not shown). In order to effectively attach the mounting lug 12 to the compressor housing 26, the protruding surface 24 of the compressor housing 26 is drilled and tapped. Bolts 28, 30 are inserted through the respective holes 20, 22 of the respective shoulder portions 16, 18 and tightened in the locations drilled and tapped in the protruding surface 24 of the compressor housing 26. Once the mounting lug 10 is fixedly attached to the protruding surface 24 of the compressor housing 26, the mounting lug 10 is aligned with holes in the mounting bracket in the vehicle, and a bolt (not shown) is typically inserted through the aperture 14 of the main body 12 to secure the mounting lug 10 to the mounting bracket.

Figure 2:
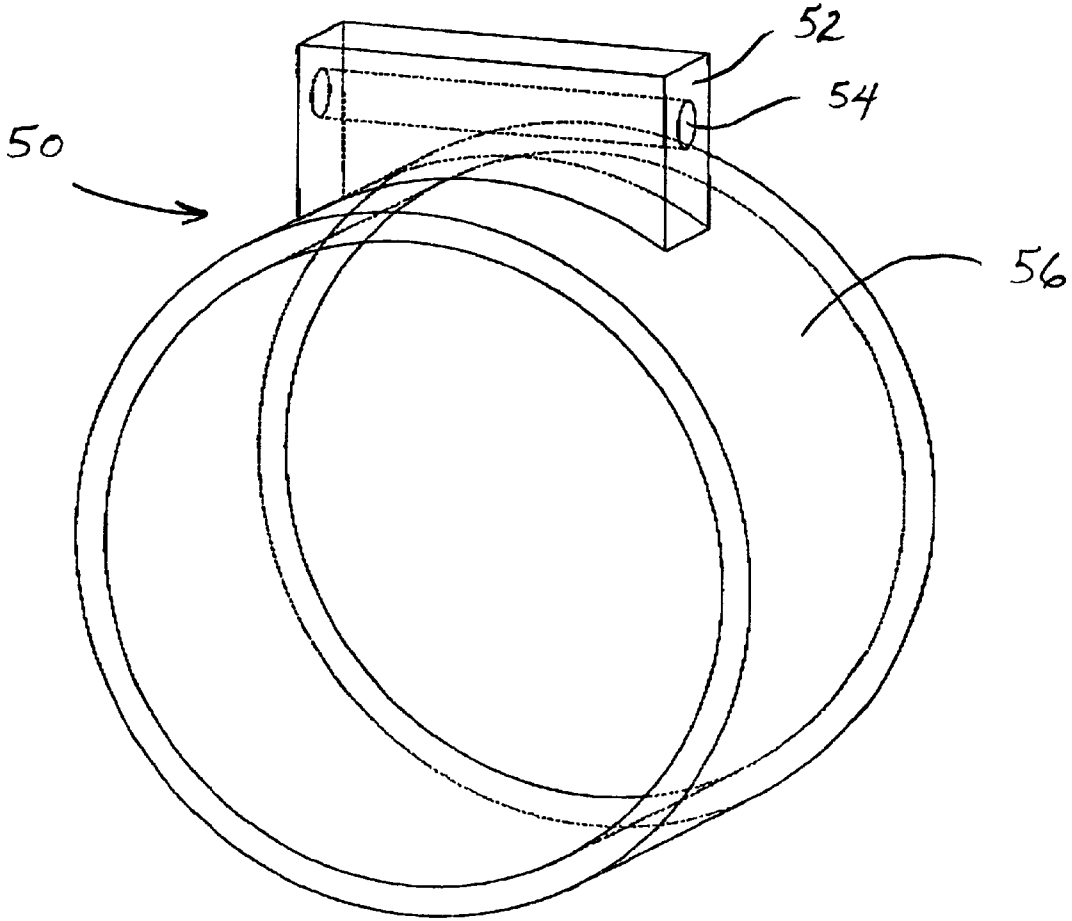
FIG. 2 is a perspective view of a second embodiment of a movable mounting lug for a variable capacity swash plate type compressor embodying the features of the present invention.

A second embodiment of a mounting lug incorporating the features of this invention is indicated generally at 50 in FIG. 2. The mounting lug 50 includes a main body 52 that is integrally molded onto an outer surface of a compressor housing 56. A lower surface of the main body 52 is complementary to the outer surface of the compressor housing 56

The main body 52 includes a longitudinal aperture 54 that preferably extends therethrough. A longitudinal axis of the aperture 54 is substantially perpendicular to a longitudinal axis of the compressor housing 56 and substantially tangent to the outer surface of the compressor housing 56.

The compressor housing 56 can have one or more mounting lugs 50 disposed thereon, depending upon the number of mounting brackets disposed on the vehicle to which the compressor housing 56 is to be mounted. The mounting lugs 50 may be placed at any location on the compressor housing 56, depending upon the location of the mounting brackets on the vehicle to which the compressor housing 56 is to be mounted.

Figure 3:
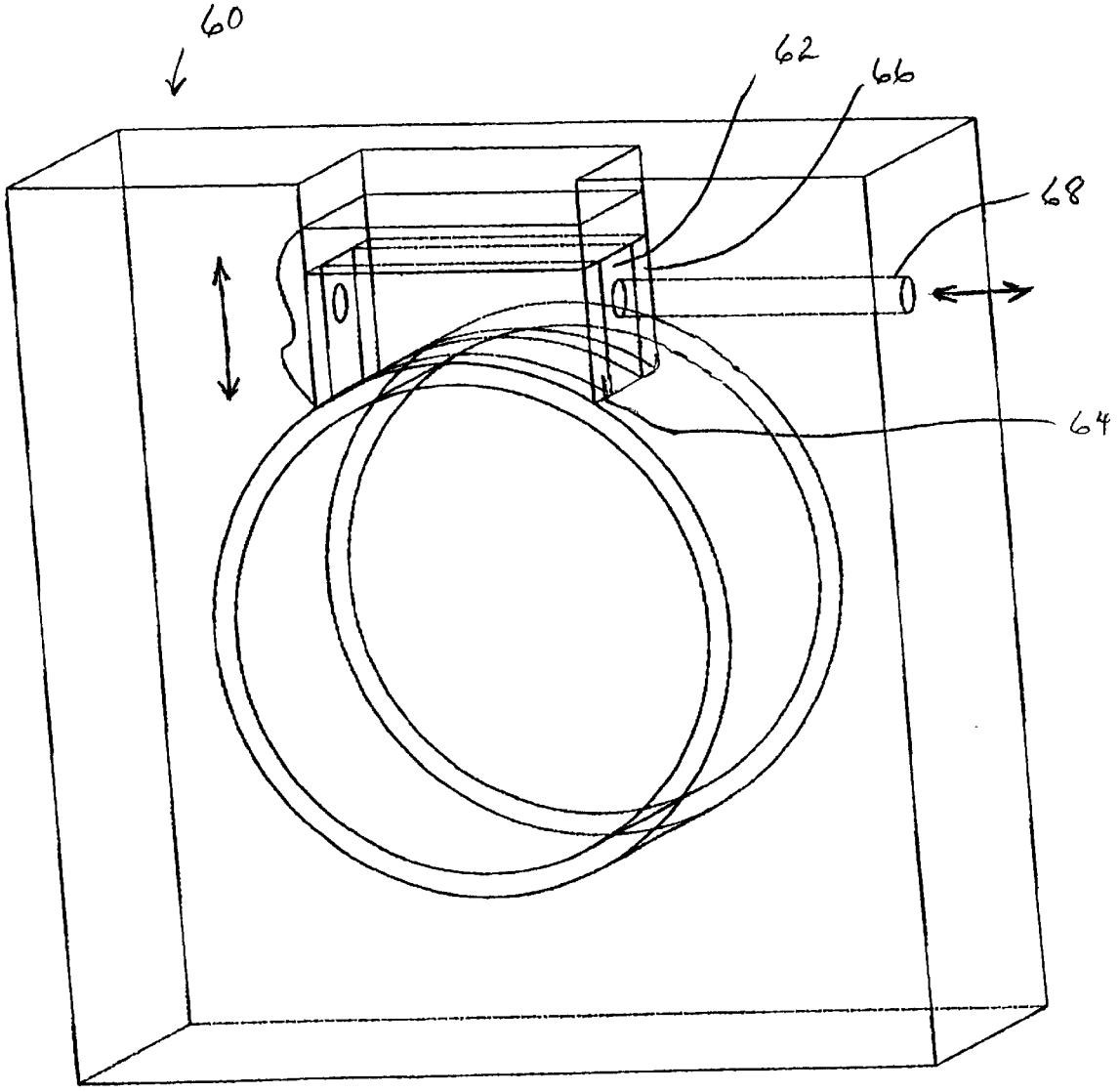
FIG. 3 is a perspective view of a die used to form the mounting lug of FIG. 2.

The mounting lug 50 is cast as an integral part of the compressor housing 56. As illustrated in FIG. 3, a die or mold 60 is used to form the mounting lug 50 as desired on the compressor housing 56. The mold 60 includes a moveable core slide 62. A pair of spacers 64 and 66 and a core pin 68 are used to locate the mounting lug 50 in an infinite number of configurations, axially and radially with respect to the compressor housing 56.

Figure 4:
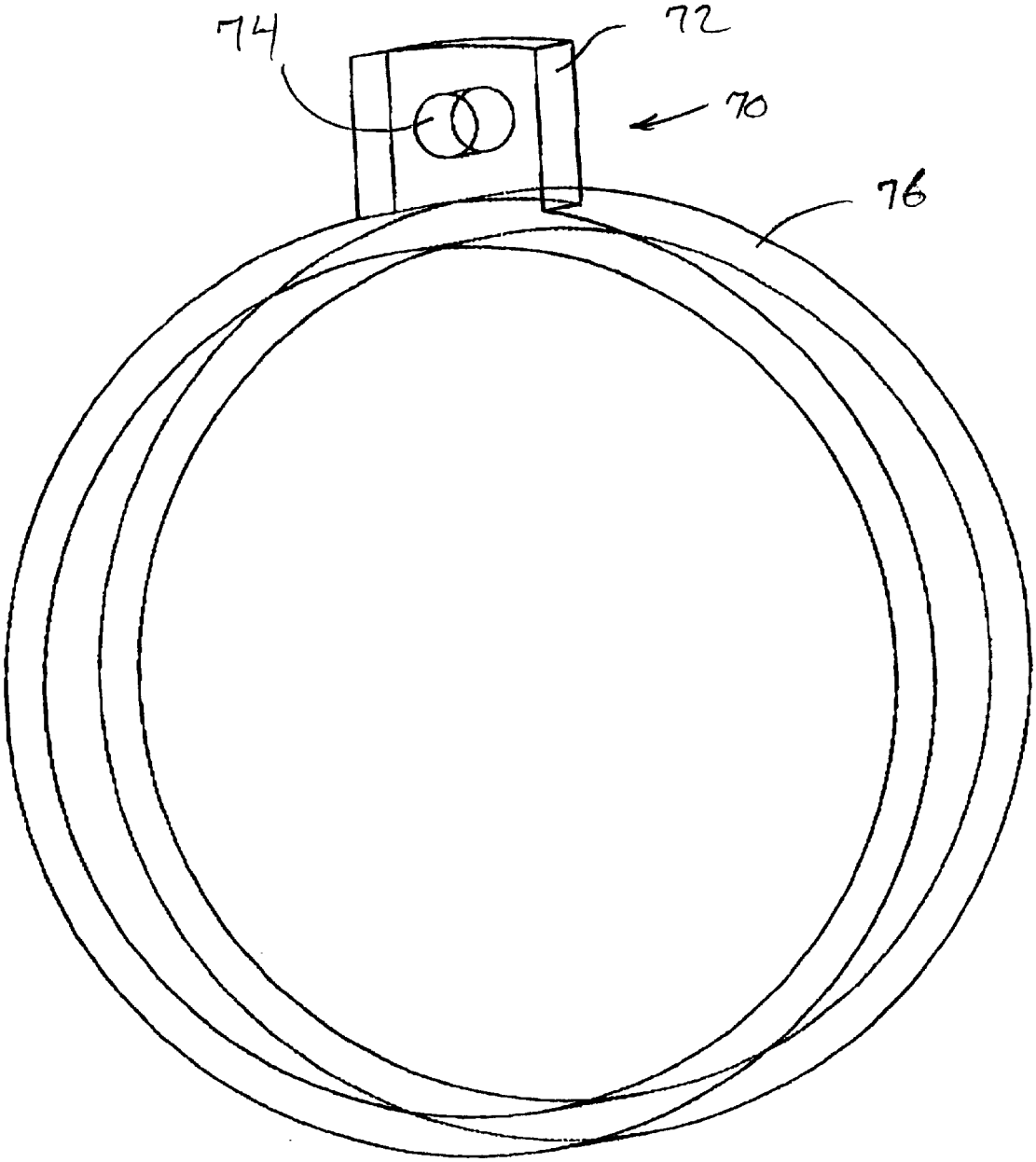
FIG. 4 is a perspective view of a third embodiment of a movable mounting lug for a variable capacity swash plate type compressor embodying the features of the present invention.

A third embodiment of a mounting lug incorporating the features of this invention is indicated generally at 70 in FIG. 4. The mounting lug 70 includes a main body 72 that is integrally molded onto an outer surface of a compressor housing 76. A lower surface of the main body 72 is complementary to the outer surface of the compressor housing 76.

The main body 72 includes a longitudinal aperture 74 that preferably extends therethrough. A longitudinal axis of the aperture 74 is substantially parallel to a longitudinal axis of the compressor housing 76 and substantially tangent to the outer surface of the compressor housing 76.

The compressor housing 76 can have one or more mounting lugs 70 disposed thereon, depending upon the number of mounting brackets disposed on the vehicle to which the compressor housing 76 is to be mounted. The mounting lugs 70 may be placed at any location on the compressor housing 76, depending upon the location of the mounting brackets on the vehicle to which the compressor housing 76 is to be mounted.

Figure 5:
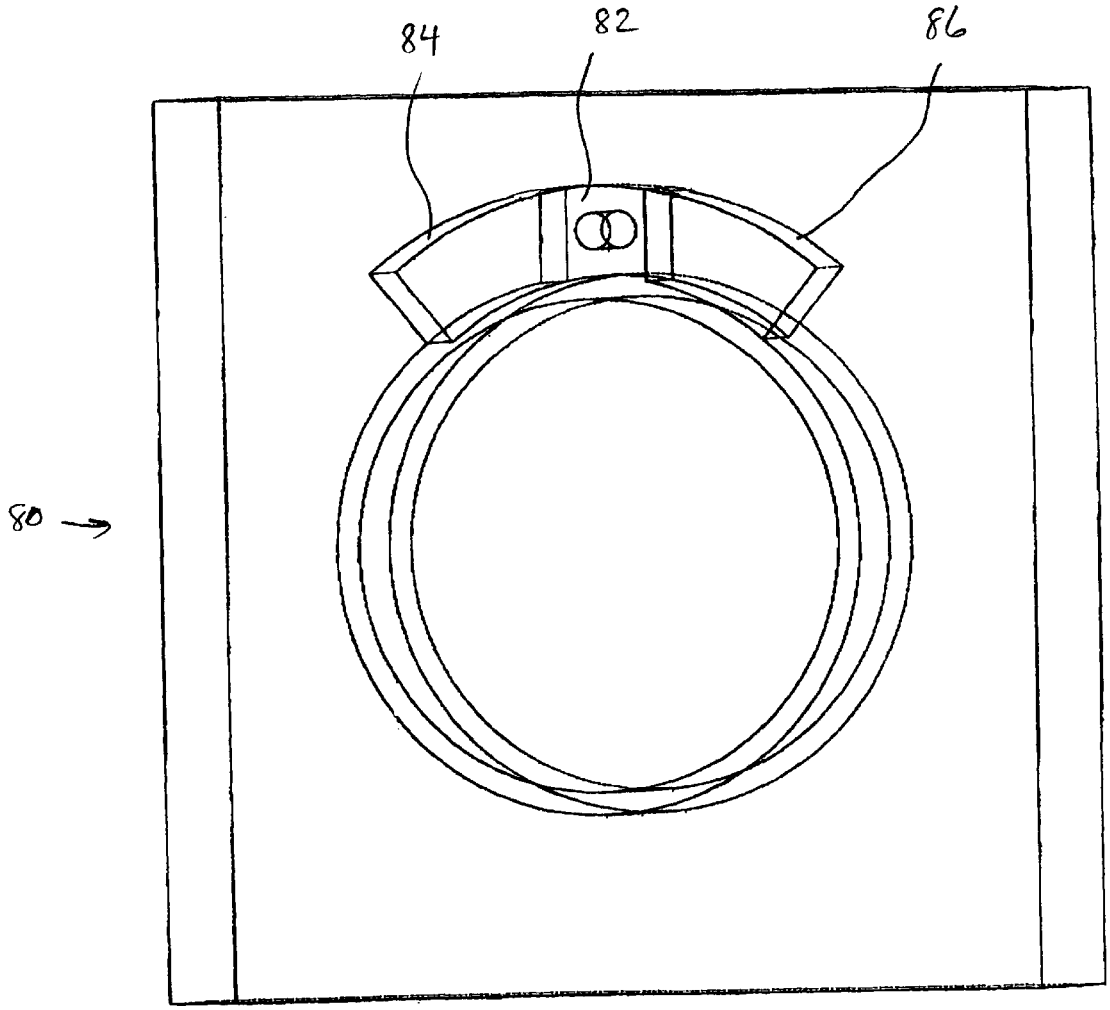
FIG. 5 is a perspective view of a die used to form the mounting lug of FIG. 4.
Figure 1:
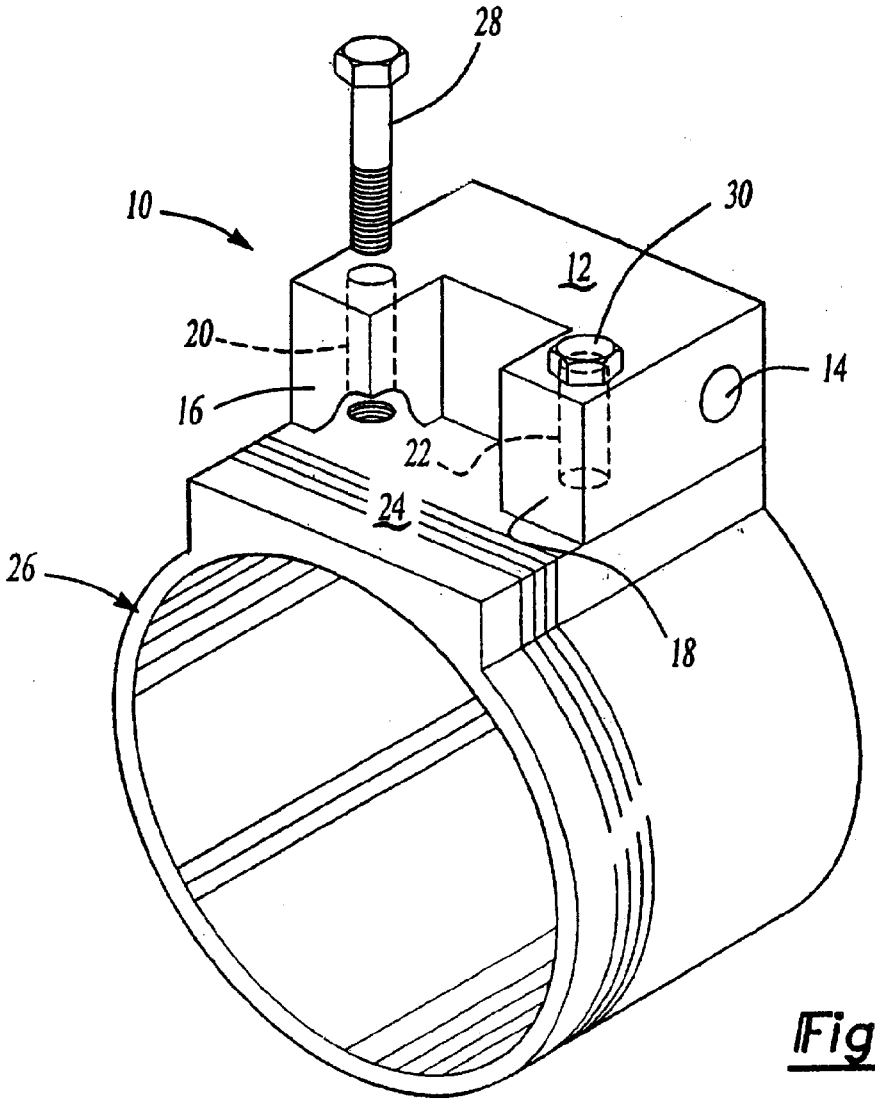
Figure 2:
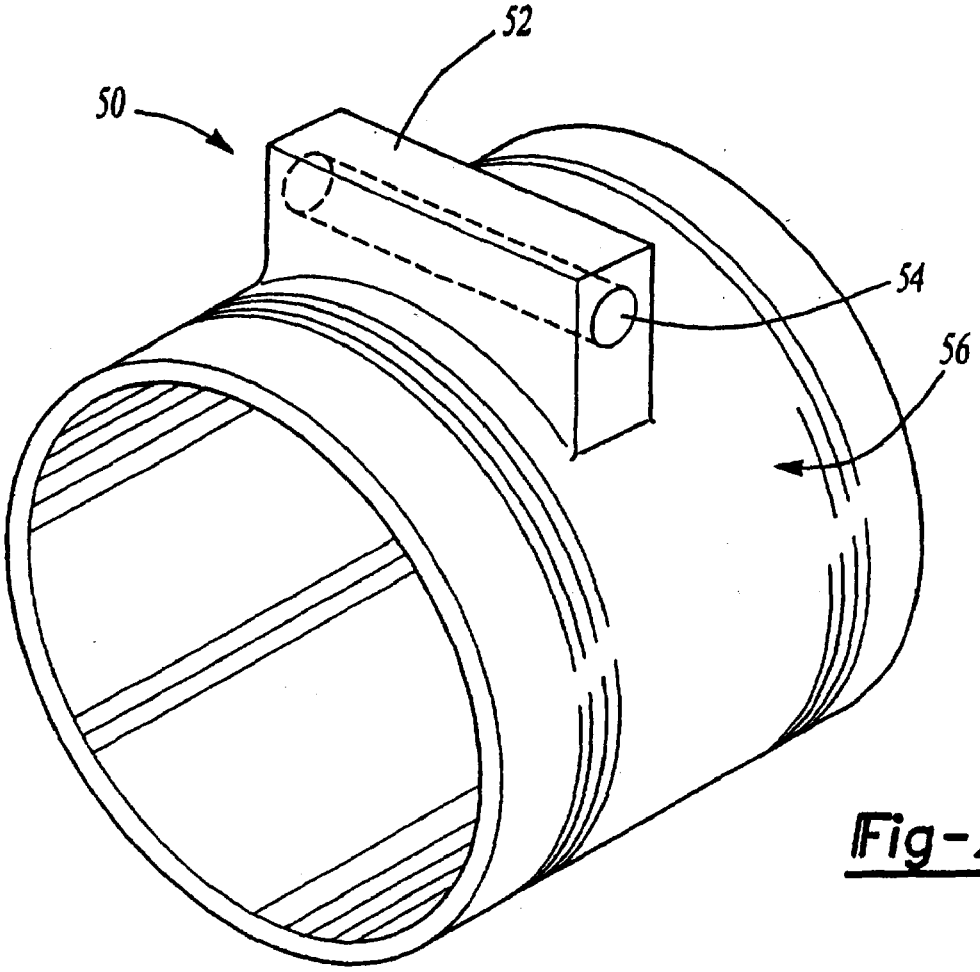
Figure 3:
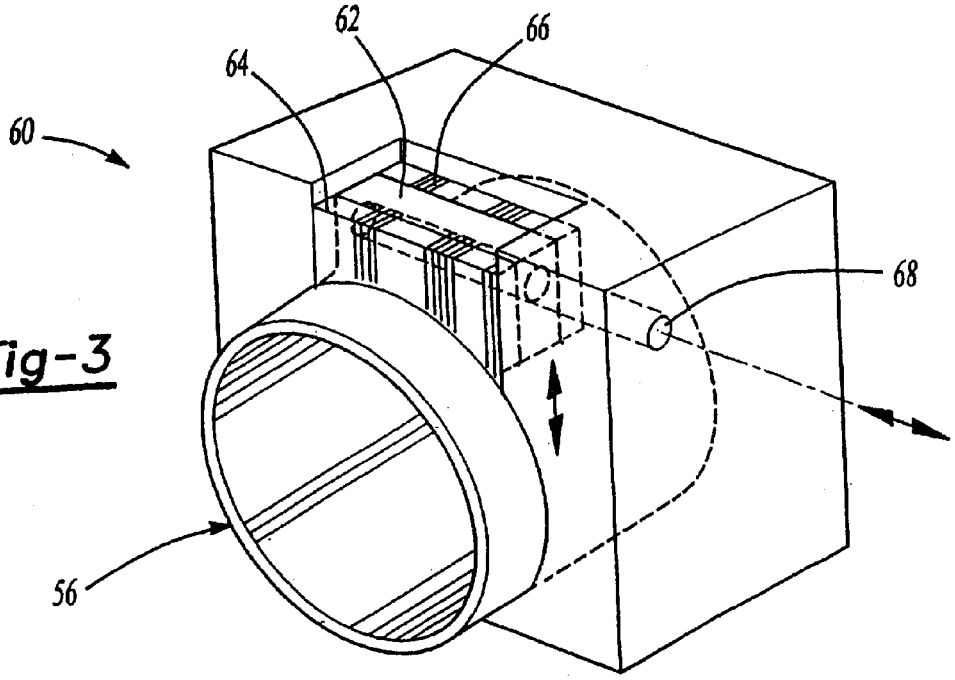
Figure 4:
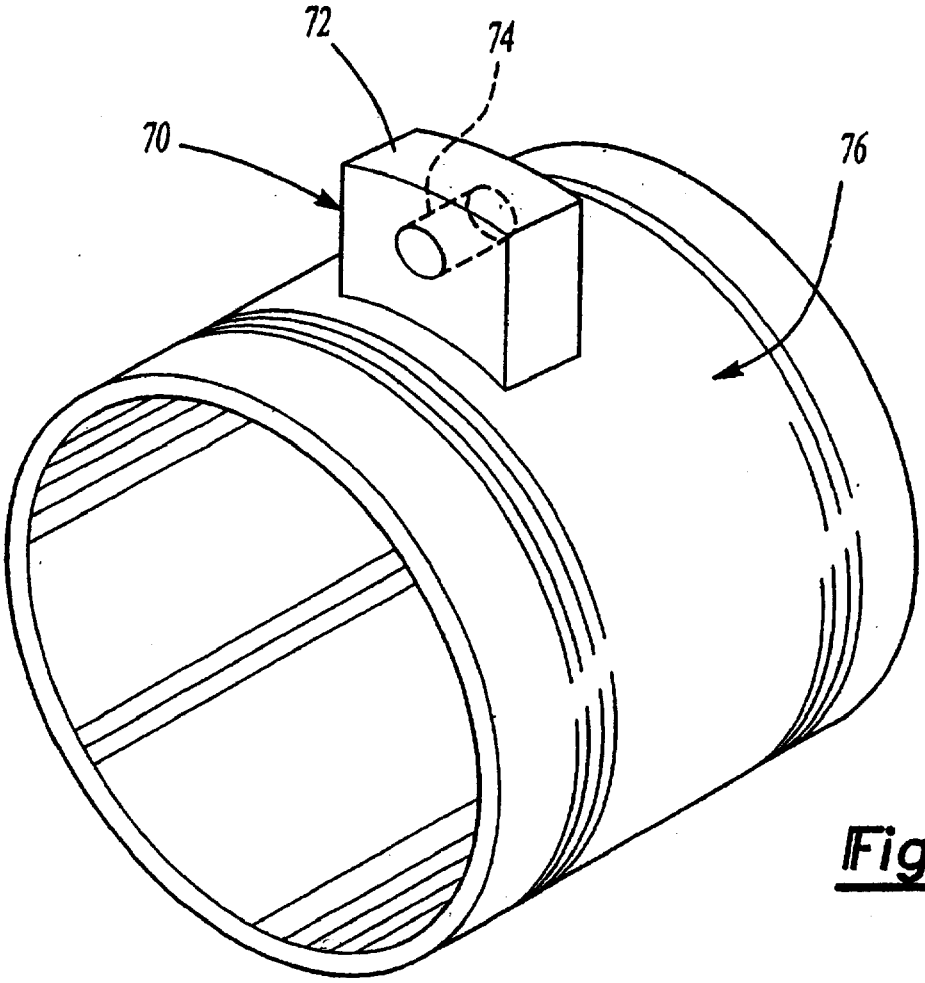
Figure 5:
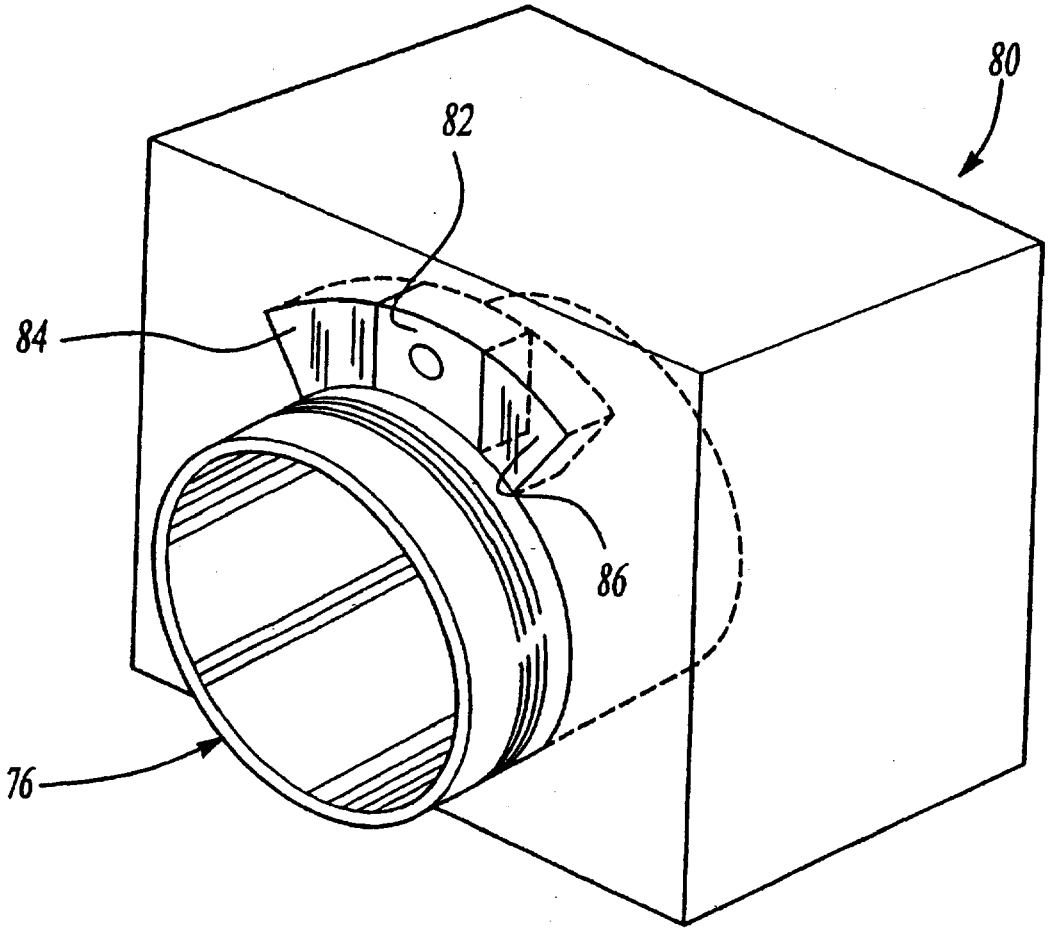

The mounting lug 70 is cast as an integral part of the compressor housing 76. As illustrated in FIG. 5, a die or mold 80 is used to form the mounting lug 70 as desired on the compressor housing 76. The mold 80 includes a moveable core slide 82. A pair of spacers 84 and 86 that are used to locate the mounting lug 70 in an infinite number of configurations, with respect to the compressor housing 76.

Several advantages are readily apparent from the mounting lugs 10, 50, and 70. Mounting lugs can be located in a variety of positions thereby improving the marketability of a single compressor. A single variable capacity swash plate type compressor may therefore be mounted in a variety of vehicles. Production costs may thereby be reduced compared to prior art swash plate type compressors. Since a compressor housing can be used on a variety of vehicle models and can be adapted to different mounting bracket configurations, only one mold is required. Since molds are costly to produce, substantial savings are experienced when a single mold is used to provide various configurations.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A combined mounting lug and compressor housing, comprising:

a mounting lug having an aperture and a hole;

a compressor housing having a longitudinal axis and including a protruding surface extending longitudinally on an outer surface of said compressor housing, the protruding surface having sufficient area so that the mounting lug can be variably positioned axially on the protruding surface; and a fastener received in the hole of the mounting lug to selectively secure the mounting lug on the compressor housing.

2. The combined mounting lug and compressor housing defined in claim 1 wherein the mounting lug includes a main body in which the aperture is formed.

3. The combined mounting lug and compressor housing defined in claim 2 wherein the aperture of the main body has a longitudinal axis extending substantially perpendicular to a longitudinal axis of the compressor housing and substantially tangent to the outer surface of the compressor housing.

4. The combined mounting lug and compressor housing defined in claim 2 further including two spaced apart shoulder portions extending from the main body.

5. The combined mounting lug and compressor housing defined in claim 4 wherein the hole of the mounting lug is formed in one of said shoulder portions and another hole is formed in the other of said shoulder portions.

* * * * *

UNITED STATES PATENT AND TRADEMARK OFFICE

CERTIFICATE OF CORRECTION

PATENT NO. : 6,460,823 B1
DATED : October 8, 2002
INVENTOR(S) : David Henry Herder et al.

It is certified that error appears in the above-identified patent and that said Letters Patent is hereby corrected as shown below:

Drawings,
Substitute Figs. 1-5 with the attached Figs. 1-5

Signed and Sealed this

Twenty-eighth Day of January, 2003

JAMES E. ROGAN
*Director of the United States Patent and Trademark Office*